United States Patent [19]

Smeller

[11] Patent Number: 4,947,998

[45] Date of Patent: Aug. 14, 1990

[54] IMPLEMENT ORGANIZER

[76] Inventor: Donald W. Smeller, 1225 W. View Dr., Wenatchee, Wash. 98801

[21] Appl. No.: 398,227

[22] Filed: Aug. 24, 1989

[51] Int. Cl.[5] ..... A47F 7/00; B65D 90/04

[52] U.S. Cl. ..... 211/70.6; 206/373; 220/410; 220/85 D

[58] Field of Search ..... 211/70.6, 71; 206/372, 206/373; 220/410, 85 R, 85 D

[56] References Cited

U.S. PATENT DOCUMENTS

| | | | |
|---|---|---|---|
| 2,230,667 | 2/1941 | Nelson | 211/70.6 |
| 2,815,863 | 12/1957 | Warson | 211/70.6 X |
| 3,298,531 | 1/1967 | Wilcke I | 211/70.6 |
| 3,298,532 | 1/1967 | Wilcke II | 211/70.6 |
| 4,826,007 | 5/1989 | Skeie | 211/70.6 X |

*Primary Examiner*—William I. Price

*Attorney, Agent, or Firm*—Kelly, Bauersfeld & Lowry

[57] ABSTRACT

An implement organizer is provided for rapid and easy mounting onto a receptacle, particularly such as a trash barrel. The implement organizer includes a lid adapted for rapid and secured mounting on the receptacle, and for receiving a multitude of implements which pass through the lid and extend downwardly to a lower nest. The nest defines an arrangement of upwardly open cups for receiving and aligning ends of the implements in a seated manner. The lid and nest are adapted to fit into substantially any receptacle within a wide range of sizes.

18 Claims, 2 Drawing Sheets

IMPLEMENT ORGANIZER

BACKGROUND OF THE INVENTION

This invention relates generally to tool organizers and so-called tool caddies of the type used in garages and basement workshops. More specifically, this invention relates to an improved implement organizer for mounting onto a receptacle such as a trash barrel, wherein the improved implement organizer comprises a lid and a nest which are adaptable to accommodate a wide range of receptacles of different sizes.

Organizers have been widely used for arranging implements, particularly such as rakes and shovels and the like. In one such system, a plurality of hooks or hanger means are mounted on a wall and the implements are suspended from the hooks. In another such system, a plurality of tubes are mounted to a rail and the tool handles are passed through the holders so that they come to rest on the floor.

While implement organizers of the types described have advantageously permitted implements to be organized, a variety of practical limitations and difficulties have arisen. For example, these organizers require the plurality of holding means to be rigidly mounted in some stationary arrangement to accommodate a particular set of implements. Accordingly to achieve adequate organization after utilizing the implements, they must be returned to their original intended arrangement. Unfortunately, when multiple users access the implements, the implements are often returned to the wrong holders and, indeed, disorganization soon ensues. If more implements are added to the collection, the only way to accommodate them is to undesirably demount the holder means and remount them in some new arrangement. Moreover, there is a limit in either the two dimensional wall area or the one dimensional rail length.

In an effort to overcome these difficulties, implement organizers have been proposed for spreading the implements over three dimensional space. More particularly, tubes have been used in bundled array to receive a plurality of implements. However the bundled tubes have been relatively expensive and require that the implements be all alike or nearly so. Accordingly these bundled arrangements have achieved very narrow utility.

There exists, therefore, a significant need for an implement organizer wherein the organizer is inexpensive and provides easy mounting, quick access and fault-free return by multiple users, and is efficient in the use of three dimensional space. The present invention fulfills these needs and provides further related advantages.

SUMMARY OF THE INVENTION

In accordance with the invention an improved implement organizer is provided for use with receptacles, such as round trash barrels or the like. The improved implement organizer is designed from a relatively small number of components adapted for easy mounting while providing a secure, stable, and orderly depository for a multitude of variously shaped implements. Moreover, the implement organizer is adaptable to fit any receptacle within a wide range of sizes.

In one preferred form the invention, the improved implement organizer includes a lid mounted on the receptacle. The lid has a plurality of holes, slots, and notches formed therein and arranged so that they receive the handles or the like of variously shaped implements which pass through the lid and extend downwardly toward a lower nest. The lid is designed with a tapered peripheral wall so as to wedge itself into the top of the receptacle. The tapered wall doubles back upon itself to minimize the depth of insertion.

The lower nest defines a set of cups arranged in generally matched relationship to the holes, slots, and notches in the lid. The cups are upwardly open and shaped to receive the end of a descending implement and deflect it into the center of the cup. The nest is secured on the bottom of the receptacle by means of crushable peripheral lobes which press against the side walls of the receptacle.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 2:
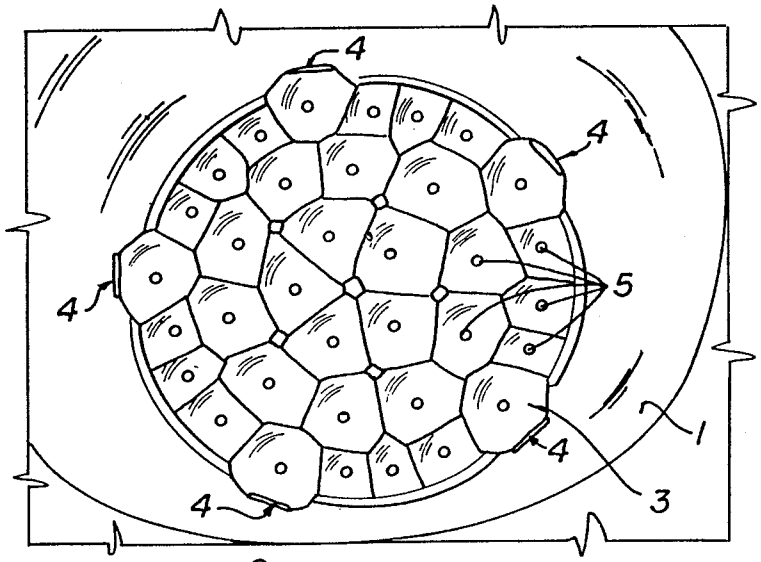
FIG. 2 is a plan view of the lower nest installed at the bottom of the receptacle and showing the outer lobes in deformed contact with the receptacle walls, taken generally in the line 2—2 of FIG. 1.
Figure 4:
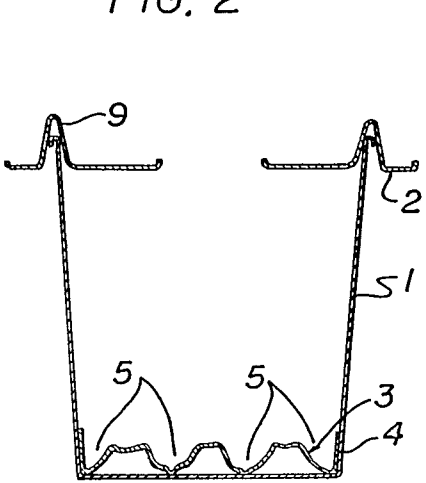
FIG. 4 is a schematic view similar to FIG. 3 but showing a smaller receptacle with the improved organizer installed with the lid in an inverted orientation and the nest with the lobes crushed to a maximum degree.
Figure 3:
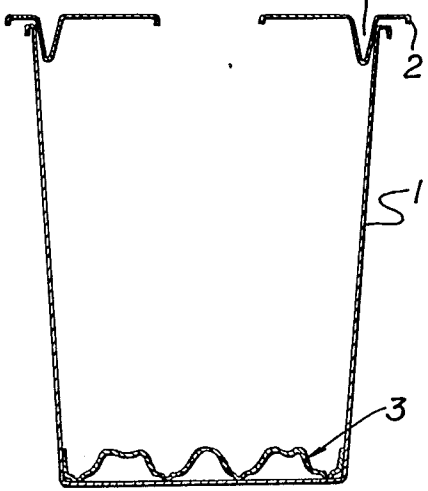
FIG. 3 is a somewhat schematic sectional view of the receptacle with the improved implement organizer installed with the lid in a normal upright orientation and the nest with the lobes lightly crushed.
Figure 1:
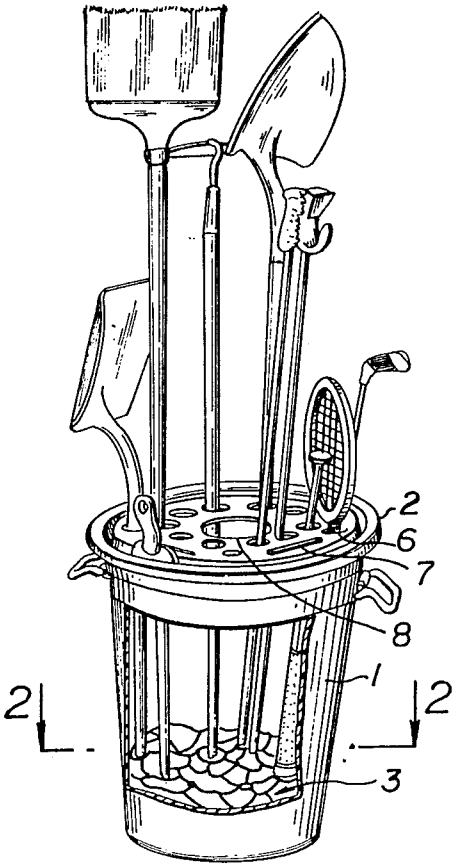
FIG. 1 is a fragmented perspective view of the improved implement organizer installed on a receptacle and showing implements in place, as examples, including a shovel, broom, hoe, D-handled shovel tennis racket golf club, baseball bat, ski poles, and drywall taping knife.
Figure 6:
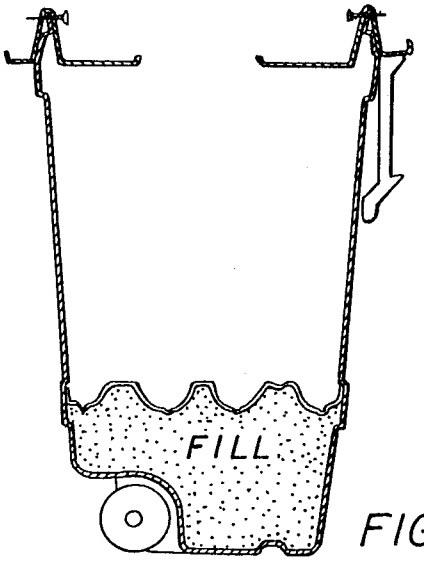
FIG. 6 is a schematic view showing the use of set screws and fill material to accommodate a case where the top of the receptacle is exactly the same diameter as the fold in the tapered lid, and also where the bottom of the receptacle is narrow as well as irregular due to a wheel feature.

As shown in the exemplary drawings, a receptacle 1 such as a conventional trash can is adapted to co-operate with an upper lid 2 and a lower nest 3 to form an improved implement organizer. The lid 2 fits in one of two positions depending on the size of the receptacle For large receptacles the lid is upright as shown in FIGS. 1, 3, 5, 7 and 8. For smaller receptacles the lid is inverted as shown in FIGS. 4 and 6. Both the lid and the nest may be conveniently formed from relatively inexpensive materials such as molded or otherwise suitably formed plastic.

The nest 3 is installed by pressing it down into the bottom of the receptacle and in so doing compressing outwardly radiating peripheral lobes 4 against, and holding the nest to the walls of the receptacle 1. The nest further defines upwardly open cups 5 located such that the cups match and co-operate with an arrangement of holes 6, slots 7, and notches 8 formed in the lid 2. In the preferred embodiment shown, the holes are not directly above the cups, but are offset slightly inwardly such that stored implements have a slight outward lean. This is for three reasons: a) to give the implements a stable home position, b) to avail the implements to a fanned out volume at the top for easier access, and c) the lean being slight and not extreme, to keep the center of gravity of the implement within the diameter of the bottom of the receptacle.

The lid 2 is installed by pressing it down onto the top of the receptacle 2. It stays due to friction and compression like a cork in a bottle. In order that the lid 2 accommodates a large range of receptacle sizes 1, a tapered circumferential wall of the lid 2 is quite long in the axial direction. However, to keep the surface of the lid containing the holes 6, slots 7, and notches 8 from being offset too far from the top of the receptacle, the tapered wall is folded back on itself as indicated by reference numeral 9. This creates the possibility as shown in FIG. 6 of having a receptacle 1 with a top of nearly the same diameter as the diameter of the fold. Such a case would otherwise be unworkable because the lid 2 would be free to rotate. But the case can be successfully treated by the use of set screws or the like as shown in FIG. 6 to fasten the lid to the receptacle.

Figure 7:
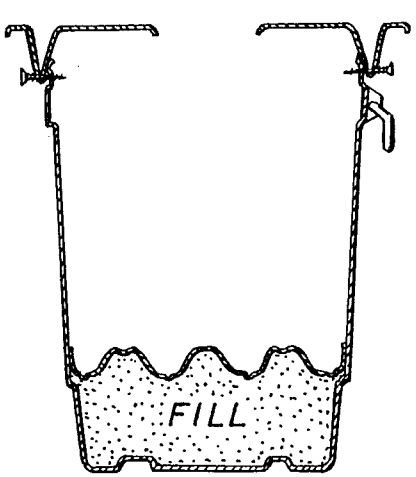
FIG. 7 is a schematic view showing the use of set screws and fill material are used to accommodate a case where the lid would tend to pop off otherwise and where the bottom of the receptacle is too narrow.
Figure 5:
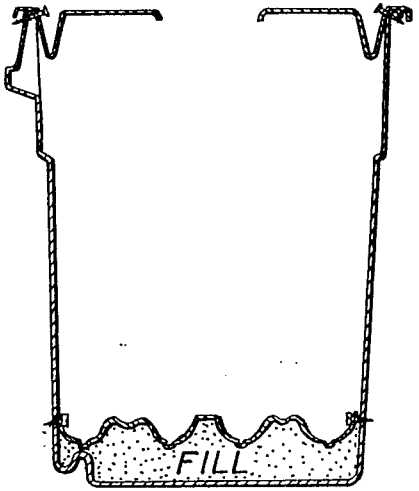
FIG. 5 is another schematic view showing the use of set screws and fill material to accommodate a case where the top of the receptacle is too large and the bottom is both too large and irregular due to a handgrip feature.
Figure 8:
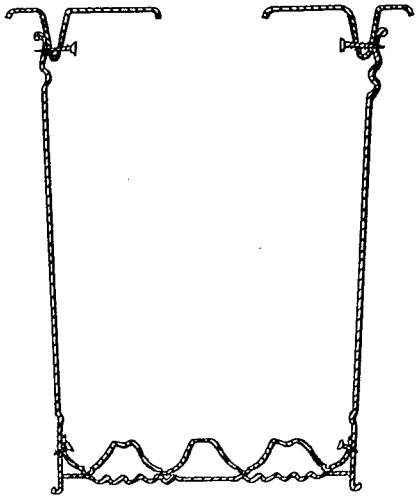
FIG. 8 is a schematic view showing the use of set screws are used to accommodate a case where the receptacle is made of metal and the sides are too

Many receptacles 1 have bottoms that are interrupted by hand grip features, wheel features, and/or are too narrow for the lobes to compress and remain compressed. The nest 3 would not seat properly on such sites and would wobble or tend to move when loaded with the implements. FIGS. 5, 6 and 7 show how these features may be accommodated through the use of fill material such as sand located within the receptacle beneath the nest.

The cups 5 in the nest are constructed with sloping and curving walls to receive the ends of the implements and to convey them gently to the cup centers without wedging regardless of the shape or size of the implement. Several small items, dowel rod for example, may be stored in the same hole/cup arrangement and they would all tend to be centered and achieve the same desirable tilt.

Various modifications to the preferred form of the improved implement organizer as described are believed to be apparent without departing from the spirit and scope of the invention. For example the receptacle need not be round; rectangular and other convenient plan sections are obvious extensions of this invention. Such shapes would have an inherent advantage over round receptacles in that the lids would be restrained from rotating when loaded by a leaning implement. No limitation is implied as to the distance between the nest 3 and the lid 2. Indeed, in another embodiment of the improved implement organizer, the nest and lid are moved to be in closer proximity such that small implements are accommodated, pliers and wrenches for example.

In yet another embodiment of the improved implement organizer, the nest is eliminated as separate part, and the cup means are incorporated into the bottom of the receptacle. Such an embodiment could utilize other means for securing the lid to the receptacle. Indeed the lid too could be unitized with the receptacle.

Other modifications of a similar nature are believed to be possible. Accordingly, no limitation on the invention is intended by way of the description herein except as set forth in the appended claims.

What is claimed is:

1. An implement organizer, said organizer comprising:

a lid defining a plurality of holes, slots and notches for passing implements through said lid in a generally vertical orientation, said lid including a pair of tapered peripheral walls doubled back on each other;

a nest defining a plurality of cup means for receiving ends of said implements; and means for separating and supporting said lid and said nest in a stable and generally vertically spaced orientation.

2. The implement organizer of claim 1 wherein said cups means each define tapered and curved sides.

3. The implement organizer of claim 1 wherein said nest includes outer lobes on its periphery.

4. The implement organizer of claim 1 further including fastener means to secure said lid and said nest to the separating means.

5. The implement organizer of claim 1 wherein the holes, slots and notches in said lid are generally aligned with said cup means.

6. The implement organizer of claim 1 wherein said cup means are offset slightly with respect to said holes, slots and notches in said lid to lean the implements outward relative to a vertical centerline of said separating means.

7. The implement organizer of claim 1 wherein said separating means comprises an upwardly open receptacle.

8. The implement organizer of claim 9 wherein the receptacle comprises a trash can.

a lid defining a plurality of holes, slots and notches for passing implements through said lid in a generally vertical orientation, said lid including a pair of tapered peripheral walls doubled back on each other;

a nest defining a plurality of cup means for receiving ends of said implements; and means for separating and supporting said lid and said nest in a stable and generally vertically spaced orientation.

9. An implement organizer, said organizer comprising:

a lid defining a plurality of holes, slots and notches for passing implements through said lid in a generally vertical orientation;

a nest defining a plurality of cup means for receiving ends of said implements, said nest including outer lobes on its periphery; and means for separating and supporting said lid and said next in a stable and generally vertically spaced orientation.

10. The implement organizer of claim 9 further including fastener means to secure said lid and said nest to the separating means.

11. The implement organizer of claim 9 wherein the holes, slots and notches in said lid are generally aligned with said cup means.

12. The implement organizer of claim 9 wherein said cup means are offset slightly with respect to said holes, slots and notches in said lid to lean the implements outward relative to a vertical centerline of said separating means.

13. The implement organizer of claim 9 wherein said separating means comprises an upwardly open receptacle.

14. The implement organizer of claim 13 wherein the receptacle comprises a trash can.

15. An implement organizer for use in combination with an upwardly open receptacle having an upper peripheral rim, said organizer comprising:

a lid having a central portion with a size and shape to extend across and substantially over the receptacle, said lid central portion defining a plurality of holes for receiving implements therethrough, said central portion being joined to a tapered outer peripheral wall shaped for substantially wedge fit engagement with the receptacle generally at the upper rim thereof to mount said lid onto the receptacle.

16. The implement organizer of claim 15 wherein the receptacle has a lower end spaced a substantial distance below said lid central portion when said lid is mounted on the receptacle.

17. The implement of claim 16 further including nest means at the lower end of the receptacle for supporting implements received through said lid central portion.

18. The implement organizer of claim 16 wherein the receptacle is a trash barrel.

* * * * *